US009995017B1

(12) United States Patent
Howell et al.

(10) Patent No.: US 9,995,017 B1
(45) Date of Patent: Jun. 12, 2018

(54) EXCAVATOR IMPLEMENT LENGTH AND ANGLE OFFSET DETERMINATION USING A LASER DISTANCE METER

(71) Applicant: Caterpillar Trimble Control Technologies LLC, Dayton, OH (US)

(72) Inventors: Mark Nicholas Howell, Christchurch (NZ); Samuel Joseph Frei, Christchurch (NZ)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 0 days. days.

(21) Appl. No.: 15/372,737

(22) Filed: Dec. 8, 2016

(51) Int. Cl.

| | |
|---|---|
| ***G06G 7/00*** | (2006.01) |
| ***E02F 3/43*** | (2006.01) |
| ***E02F 3/32*** | (2006.01) |
| ***E02F 9/26*** | (2006.01) |
| ***E02F 9/20*** | (2006.01) |

(52) U.S. Cl.
CPC ..... *E02F 3/435* (2013.01); *E02F 3/32* (2013.01); *E02F 9/2025* (2013.01); *E02F 9/265* (2013.01)

(58) Field of Classification Search
USPC ..... 701/50
See application file for complete search history.

(56) References Cited

U.S. PATENT DOCUMENTS

| | | | | |
|---|---|---|---|---|
| 4,829,418 | A | 5/1989 | Nielsen et al. | |
| 5,848,485 | A * | 12/1998 | Anderson | E02F 3/435 356/141.1 |
| 6,253,160 | B1 | 6/2001 | Hanseder | |
| 6,263,595 | B1 * | 7/2001 | Ake | E02F 3/435 356/141.1 |
| 6,480,289 | B1 * | 11/2002 | Shimomura | E21D 9/004 356/614 |
| 2003/0147727 | A1 * | 8/2003 | Fujishima | E02F 3/435 414/200 |

(Continued)

OTHER PUBLICATIONS

Trimble GCS900 Grade Control System for Excavators, Version 12.60, Revision A, Part No. Feb. 2014.

*Primary Examiner* — Tyler Paige
(74) *Attorney, Agent, or Firm* — Dinsmore & Shohl, LLP

(57) ABSTRACT

A framework comprises a laser distance meter (LDM), first and second laser reflectors at respective nodes, and an excavator including a chassis, a linkage assembly (LA) including a boom and stick, an implement including the nodes and tilting about axis TA, an implement sensor generating signal $\theta_{tilt}$, and architecture. The LDM generates LDM distance signals $D_{LDM}$ and LDM angle of inclination signals $\theta_{INC}$ between the LDM and the laser reflectors. The architecture comprises LA actuators and a controller programmed to determine the TA relative to horizontal based on $\theta_{tilt}$ and execute an iterative process to curl the excavating implement and create bucket angles, align the LDM and the first node to determine a set of rotated IDV, align the LDM and the second node to determine a set of rotated IPV, and determine implement dimensions between the nodes based on the set of rotated IDV and IPV.

20 Claims, 3 Drawing Sheets

(56) References Cited

U.S. PATENT DOCUMENTS

| | | | | |
|---|---|---|---|---|
| 2003/0226290 | A1* | 12/2003 | Savard | E01C 19/006 37/348 |
| 2013/0333364 | A1* | 12/2013 | Carpenter | F15B 3/00 60/327 |
| 2015/0330060 | A1 | 11/2015 | Seki et al. | |
| 2016/0054114 | A1 | 2/2016 | Crozier et al. | |

* cited by examiner

EXCAVATOR IMPLEMENT LENGTH AND ANGLE OFFSET DETERMINATION USING A LASER DISTANCE METER

BACKGROUND

The present disclosure relates to excavators which, for the purposes of defining and describing the scope of the present application, comprise an excavator boom and an excavator stick subject to swing and curl, and an excavating implement that is subject to swing and curl control with the aid of the excavator boom and excavator stick, or other similar components for executing swing and curl movement. For example, and not by way of limitation, many types of excavators comprise a hydraulically or pneumatically or electrically controlled excavating implement that can be manipulated by controlling the swing and curl functions of an excavating linkage assembly of the excavator. Excavator technology is, for example, well represented by the disclosures of U.S. Pat. No. 8,689,471, which is assigned to Caterpillar Trimble Control Technologies LLC and discloses methodology for sensor-based automatic control of an excavator, US 2008/0047170, which is assigned to Caterpillar Trimble Control Technologies LLC and discloses an excavator 3D laser system and radio positioning guidance system configured to guide a cutting edge of an excavator bucket with high vertical accuracy, and US 2008/0000111, which is assigned to Caterpillar Trimble Control Technologies LLC and discloses methodology for an excavator control system to determine an orientation of an excavator sitting on a sloped site.

BRIEF SUMMARY

According to the subject matter of the present disclosure, an excavator calibration framework comprises an excavator, a laser distance meter (LDM), a first laser reflector, and a second laser reflector. The excavator comprises a machine chassis, an excavating linkage assembly, an implement dynamic sensor, an excavating implement, and control architecture. The excavating linkage assembly comprises an excavator boom and an excavator stick that collectively define a plurality of linkage assembly positions. The excavating implement is mechanically coupled to the excavator stick. The excavating implement is configured to tilt about a tilt axis. The implement dynamic sensor is positioned on the excavating implement and is configured to generate a tilt angle signal ($\theta_{tilt}$) representing an angular degree to which the tilt axis of the excavating implement is tilted with respect to horizontal. The first laser reflector is positioned at a first calibration node on the excavating implement. The second laser reflector is positioned at a second calibration node on the excavating implement. The LDM is configured to generate a first LDM distance signal $D_{LDM1}$ indicative of a distance between the LDM and the first laser reflector and a first LDM angle of inclination signal $\theta_{INC1}$ indicative of an angle between the LDM and the first laser reflector. The LDM is configured to generate a second LDM distance signal $D_{LDM2}$ indicative of a distance between the LDM and the second laser reflector and a second LDM angle of inclination signal $\theta_{INC2}$ indicative of an angle between the LDM and the second laser reflector. The control architecture comprises one or more linkage assembly actuators and an architecture controller programmed to determine the tilt axis of the excavating implement relative to horizontal based on the tilt angle signal ($\theta_{tilt}$) and execute an iterative process to curl the excavating implement and create a set of bucket angles. The architecture controller is further programmed to move the linkage assembly to align the LDM and the first calibration node, calculate a pair of first calibration node measurements based on the first LDM distance signal $D_{LDM1}$ and the first LDM angle of inclination signal $\theta_{INC1}$, determine a first set of dimensions comprising implement distance values and LDM offset values, wherein the first set of dimensions are at least partially based on the set of bucket angles and the pair of first calibration node measurements, align the tilt axis with horizontal to generate a first rotation factor, and determine a set of rotated implement distance values at least partially based on the implement distance values and the first rotation factor. The architecture controller is further programmed to move the linkage assembly to align the LDM and the second calibration node, calculate a pair of second calibration node measurements based on the second LDM distance signal $D_{LDM2}$ and the second LDM angle of inclination signal $\theta_{INC2}$, determine a second set of dimensions comprising implement profile values, wherein the second set of dimensions is at least partially based on the pair of second calibration node measurements and the LDM offset values, align the tilt axis with horizontal to generate a second rotation factor, and determine a set of rotated implement profile values at least partially based on the implement profile values and the second rotation factor. The architecture controller is further programmed to determine implement dimensions between the first calibration node and the second calibration node at least partially based on the set of rotated implement distance values and the set of rotated implement profile values, and operate the excavator using the implement dimensions.

Although the concepts of the present disclosure are described herein with primary reference to the excavator illustrated in FIG. 1, it is contemplated that the concepts will enjoy applicability to any type of excavator, regardless of its particular mechanical configuration. For example, and not by way of limitation, the concepts may enjoy applicability to a backhoe loader including a backhoe linkage.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure relates to earthmoving machines and, more particularly, to earthmoving machines such as excavators including components subject to adaptive control. For example, and not by way of limitation, many types of excavators typically have a hydraulically controlled earthmoving implement that can be manipulated by a joystick or other means in an operator control station of the machine, and is also subject to partially or fully automated control. The user of the machine may control the lift, tilt, angle, and pitch of the implement. In addition, one or more of these variables may also be subject to partially or fully automated control based on information sensed or received by an adaptive environmental sensor of the machine. In the embodiments described herein, an excavator calibration framework utilizes a laser distance meter to determine excavator implement lengths and angle offsets of sensors disposed thereon, as described in greater detail further below. Such determined values may be utilized by an excavator control to operate the excavator.

Figure 1:
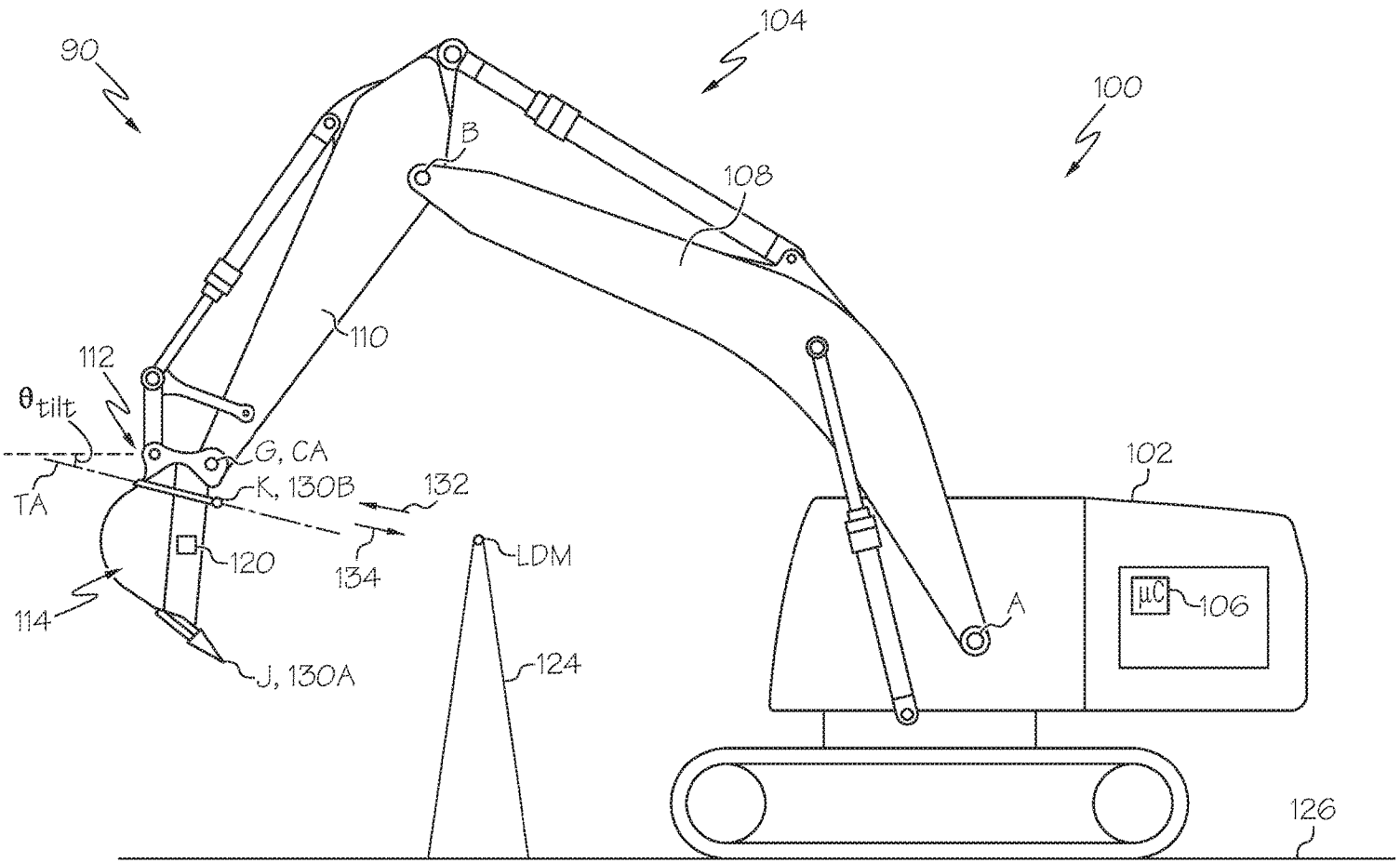
FIG. 1 is a side view of an excavator incorporating aspects of the present disclosure.

Referring initially to FIG. 1, an excavator calibration framework 90 comprises an excavator 100, a laser distance meter (LDM) 124, a first laser reflector 130A, and a second laser reflector 130B. The excavator 100 comprises a machine chassis 102, an excavating linkage assembly 104, an implement dynamic sensor 120, an excavating implement 114, and control architecture 106. The excavating linkage assembly 104 comprises an excavator boom 108 and an excavator stick 110 that collectively define a plurality of linkage assembly positions. In embodiments, one or more dynamical sensors may be positioned on excavator components such as, for example, the excavator boom 108, the excavator stick 110, and/or the machine chassis 102. The excavating linkage assembly 104 may be configured to swing with, or relative to, the machine chassis 102. Further, the excavator stick 110 may be configured to curl relative to the excavator boom 108. While the excavator 100 will be referenced herein, it should be understood that the embodiments described below also apply to other types of excavators, including those having a two-piece, variable-angle (VA) excavator boom.

The excavating implement 114 is mechanically coupled to the excavator stick 110. Further, the excavating implement 114 is configured to tilt about a tilt axis TA. In embodiments, the excavating implement 114 is mechanically coupled to a terminal point G of the excavator stick 110. The terminal point G intersects a curl axis CA about which the excavating implement 114 is configured to curl. The excavating implement 114 may be mechanically coupled to the excavator stick 110 through an implement coupling 112. For example, the excavating implement 114 may be mechanically coupled to the excavator stick 110 via the implement coupling 112 and configured to rotate about a rotary axis. In an embodiment, the rotary axis may be defined by the implement coupling 112 joining the excavator stick 110 and the excavating implement 114. In an alternative embodiment, the rotary axis R may be defined by a multidirectional, stick coupling joining the excavator boom 108 and the excavator stick 110 along a plane such that the excavator stick 110 is configured to rotate about the rotary axis. Rotation of the excavator stick 110 about the rotary axis defined by the stick coupling may result in a corresponding rotation of the excavating implement 114, which is coupled to the excavator stick 110, about the rotary axis defined by the stick coupling.

Figure 2:
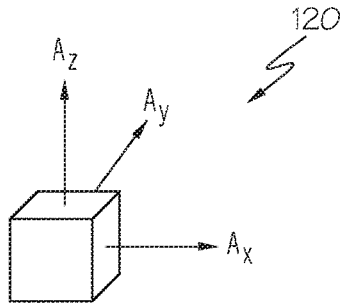
FIG. 2 is a perspective view of a dynamic sensor disposed on a linkage of the excavator of FIG. 1 and according to various concepts of the present disclosure

The implement dynamic sensor 120 is positioned on the excavating implement 114 and is configured to generate a tilt angle signal ($\theta_{tilt}$) representing an angular degree to which the tilt axis TA of the excavating implement is tilted with respect to horizontal. In embodiments, the implement dynamic sensor 120 comprises an inertial measurement unit (IMU), an inclinometer, an accelerometer, a gyroscope, an angular rate sensor, a rotary position sensor, a position sensing cylinder, or combinations thereof. The IMU may comprise a 3-axis accelerometer and a 3-axis gyroscope. As shown in FIG. 2, the implement dynamic sensor 120 includes accelerations $A_x$, $A_y$, and $A_z$, respectively representing x-axis, y-axis-, and z-axis acceleration values.

The first laser reflector 130A is positioned at a first calibration node on the excavating implement 114. The second laser reflector 130B is positioned at a second calibration node on the excavating implement 114. In embodiments, the excavating implement 114 comprises a terminal point J and a tilt point K, which intersects a point of the tilt axis TA and is disposed above the implement dynamic sensor 120. The first calibration node is positioned at the terminal point J of the excavating implement 114, and the second calibration node is positioned at the tilt point K of the excavating implement 114.

The LDM 124 is configured to generate a first LDM distance signal $D_{LDM1}$ indicative of a distance between the LDM 124 and the first laser reflector 130A and a first LDM angle of inclination signal $\theta_{INC1}$ indicative of an angle between the LDM 124 and the first laser reflector 130A. The LDM 124 is configured to generate a second LDM distance signal $D_{LDM2}$ indicative of a distance between the LDM 124 and the second laser reflector 130B and a second LDM angle of inclination signal $\theta_{INC2}$ indicative of an angle between the LDM 124 and the second laser reflector 130B. In embodiments, the first laser reflector 130A and the second laser reflector 130B are positioned at the first calibration node and the second calibration node, respectively, by direct securement to the excavating implement 114, with the use of a reflector support pole, or a combination thereof. The LDM 124 may be, for example, a Bosch GLM 100C LDM as made commercially available by Robert Bosch GmbH of Germany. A laser signal from the LDM 124 may be transmitted in a direction of an arrow 132 to the calibration node 128 and an aligned laser reflector, such as, for example, the first laser reflector 130A or the second laser reflector 130B, and the laser signal may be reflected back to the LDM 124 in the direction of an arrow 134, as illustrated in FIG. 1.

The control architecture 106 comprises one or more linkage assembly actuators and an architecture controller. In embodiments, the one or more linkage assembly actuators facilitate movement of the excavating linkage assembly 104. The one or more linkage assembly actuators may comprise a hydraulic cylinder actuator, a pneumatic cylinder actuator, an electrical actuator, a mechanical actuator, or combinations thereof. Further, the control architecture 106 may comprise a non-transitory computer-readable storage medium comprising the machine readable instructions.

Figure 4:
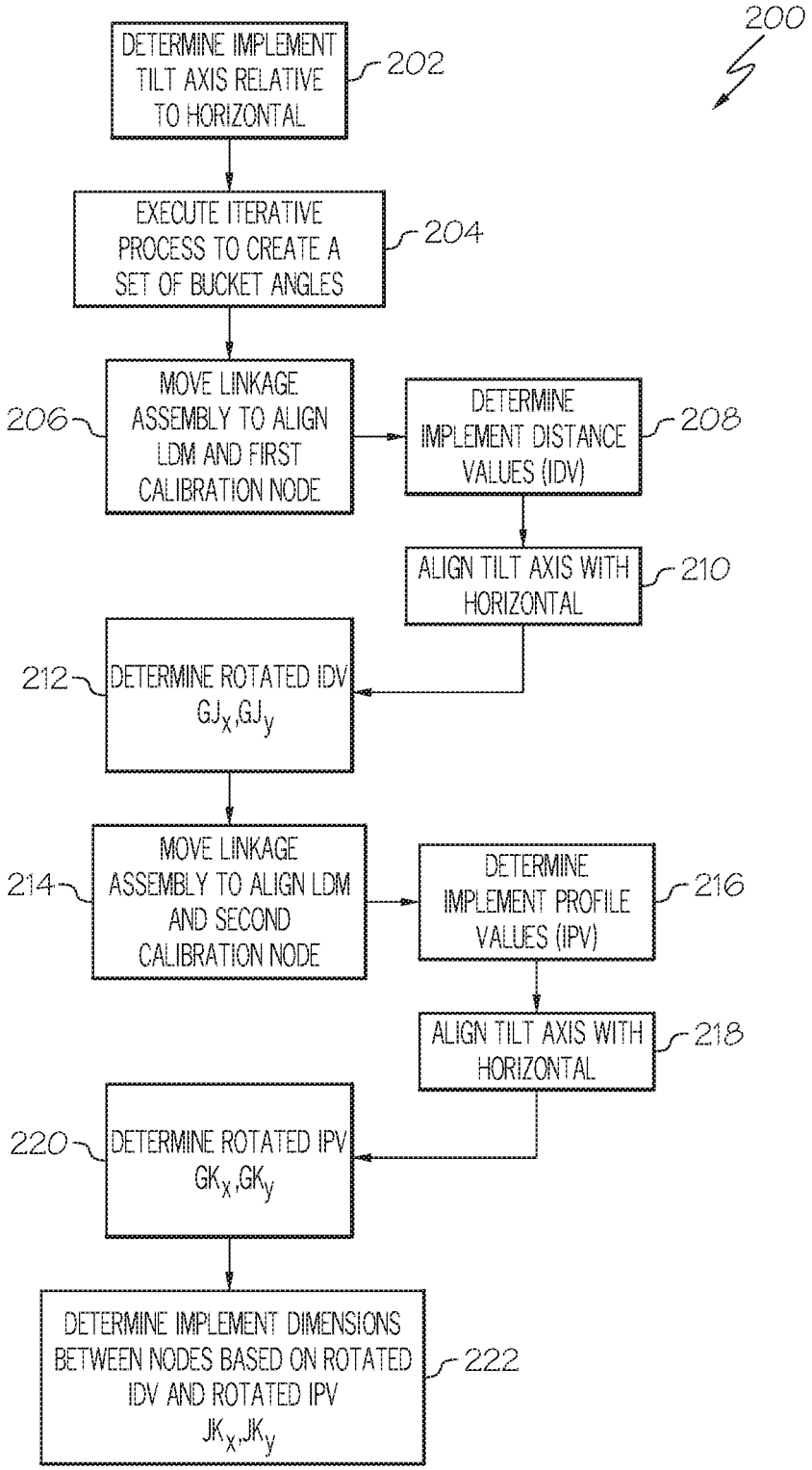
FIG. 4 is a flow chart of an optimization process used to determine implement dimensions of the excavating implement of the excavator of FIG. 1.

As shown through step 202 of a control scheme 200 of FIG. 4, the architecture controller is programmed to determine the tilt axis TA of the excavating implement 114 relative to horizontal based on the tilt angle signal ($\theta_{tilt}$). Further, as set forth in step 204 of the control scheme 200 of FIG. 4, the architecture controller is programmed to execute an iterative process to curl the excavating implement 114 and create a set of bucket angles. In embodiments, the iterative process comprises curling the excavating implement 114 about the curl axis CA to a linkage assembly position, and determining a bucket angle ($\theta_{bucket}$) of the terminal point J relative to horizontal at the linkage assembly position. The iterative process may be repeated n times until n exceeds a threshold.

Further, the architecture controller may be programmed to determine a set of rotated implement distance values through steps 206-212 of FIG. 4. For example, in step 206, the architecture controller is programmed to move the linkage assembly 104 to align the LDM 124 and the first calibration node. In step 208, the architecture controller is programmed to determine implement distance values (IDV). For example, the architecture controller is programmed to calculate a pair of first calibration node measurements based on the first LDM distance signal $D_{LDM1}$ and the first angle of inclination signal $\theta_{INC1}$, and to determine a first set of dimensions comprising the implement distance values (IDV) and LDM offset values. The first set of dimensions are at least partially based on the set of bucket angles and the pair of first calibration node measurements. In embodiments, the first set of dimensions further comprise an offset bucket angle ($\theta_{bucket,offset}$), a length (GJ) between the terminal point G and the terminal point J, a horizontal distance ($GJ_{y0}$) between the terminal point G and the terminal point J, and a vertical distance ($GJ_{y0}$) between the terminal point G and the terminal point J. In step 210, the architecture controller is programmed to align the tilt axis with horizontal to generate a first rotation factor. In step 212, the architecture controller is programmed to determine a set of rotated implement distance values at least partially based on the implement distance values (IDV) and the first rotation factor.

In embodiments, the implement distance values (IDV) comprise a horizontal distance ($GJ_{y0}$) and a vertical distance ($GJ_{y0}$) between the terminal point G of the excavator stick 110 and the terminal point J of the excavating implement 114. Further, the rotated implement distance values comprise a rotated horizontal distance ($Gj_x$) and a rotated vertical distance ($GJ_y$).

The pair of first calibration node measurements may comprise a height H and a distance D between the first calibration node and the LDM based on the LDM distance signal $D_{LDM}$ and angle of inclination signal $\theta_{INC}$, such that $$D=D_{LDM}\cos(\theta_{INC}),\text{ and}$$

$$H=D_{LDM}\sin(\theta_{INC}). \qquad \text{(Equations 1-2)}$$

Further, the LDM offset values may define an offset horizontal distance ($D_0$) and an offset vertical distance ($H_0$) between a boom terminal point A and a laser origin (for example, the LDM point of FIGS. 1 and 3) of the LDM 124. In embodiments, in which the first set of dimensions further comprise an offset bucket angle ($\theta_{bucket,offset}$), and a length (GJ) between the terminal point G and a terminal point J of the excavating implement 114, at which terminal point J the first calibration node is positioned, the first set of dimensions are determined based on a following set of first dimension equations:

$$AG_y+GJ\cos(\theta_{bucket}^{Measured}-\theta_{bucket,offset})=H+H_0;\text{ and}$$

$$AG_x+GJ\sin(\theta_{bucket}^{Measured}-\theta_{bucket,offset})=D+D_0. \qquad \text{(Equations 3-4)}$$

With respect to Equations 3-4, $\theta_{bucket}=\theta_{bucket}^{Measured}-\theta_{bucket,offset}$ and is an actual bucket angle, $AG_x$ is a horizontal distance between the boom terminal point A and the terminal point G of the excavator stick 110, and $AG_y$ is a vertical distance between the boom terminal point A and the terminal point G of the excavator stick 110. Further, solutions to the first dimension equations (i.e., Equations 3-4) are determined by a following solution set, in which:

$$cb=\cos(\theta_{bucket}^{Measured});$$

$$sb=\sin(\theta_{bucket}^{Measured}$$

$$rhs=[AG_x-D,AG_y-H];$$

$$lhs=[[\text{ones};\text{zeros}],[\text{zeros};\text{ones}],[cb;sb],[-sb;cb]];\text{ and}$$

$$sol=((lhs)(lhs)^T)^{-1}(lhs)^T(rhs) \qquad \text{(Equations 5-9)}$$

From Equations 5-9, the follow set of solutions may be determined:

$$H_0=sol(1);$$

$$D_0=sol(2);$$

$$cGJ=sol(3);$$

$$sGJ=sol(4);\text{ and}$$

$$\theta_{bucket,offset}=\tan^{-1}(SGJ,cGJ). \qquad \text{(Equations 10-14)}$$

From Equations 10-14 above, two more solutions for GJ are derivable:

$$GJ_{sol,1}=sol(3)/\cos(\theta_{bucket,offset});\text{ and}$$

$$GJ_{sol,2}=sol(4)/\sin(\theta_{bucket,offset}). \qquad \text{(Equations 15-16)}$$

Equations 15-16 may be set equal to one another, as shown in Equation 17 below, such that an approximation of GJ may equal either one, and is taken to equal Equation 15 in Equation 18 below.

$$GJ_{sol,1}=GJ_{sol,2};\text{ and}$$

$$GJ_{approx}=GJ_{sol,1}. \qquad \text{(Equations 17-18)}$$

Further, the implement distance values comprise $GJ_{y0}$ and $GJ_{x0}$, which are determined as follows:

$$GJ_{y0}=cb*cGJ-sb*sGJ;\text{ and}$$

$$GJ_{x0}=sb*cGJ+cb*sGJ. \qquad \text{(Equations 19-20)}$$

In embodiments, first rotation factor is at least partially based on $\theta_{tilt}$. Further, the set of rotated implement distance values comprise $GJ_y$ and $GJ_x$, which are based on a following set of implement distance rotation equations:

$$GJ_y=GJ_{y0}\cos(\theta_{tilt})-GJ_{x0}\sin(\theta_{tilt});\text{ and}$$

$$GJ_x=GJ_{y0}\sin(\theta_{tilt})+GJ_{x0}\cos(\theta_{tilt}). \qquad \text{(Equations 21-22)}$$

The architecture controller may be programmed to further determine a set of rotated implement profile values through steps 214-220 of FIG. 4. For example, in step 214, the architecture controller is programmed to move the linkage assembly 104 to align the LDM 124 and the second calibration node. In step 216, the architecture controller is programmed to determine implement profile values (IPV). For example, the architecture controller is programmed to calculate a pair of second calibration node measurements based on the second LDM distance signal $D_{LDM2}$ and the second angle of inclination signal $\theta_{INC2}$, and to determine a second set of dimensions comprising the implement profile values (IPV). The second set of dimensions is at least partially based on the pair of second calibration node measurements and the LDM offset values. In step 218, the architecture controller is programmed to align the tilt axis with horizontal to generate a second rotation factor. And in step 220, the architecture controller is programmed to determine a set of rotated implement profile values at least partially based on the implement profile values (IPV) and the second rotation factor.

In embodiments, the implement profile values (IPV) comprise a horizontal distance ($GK_{x0}$) and a vertical distance ($GK_{y0}$) between the terminal point G of the excavator stick 110 and the tilt point K of the excavating implement 114. Further, the rotated implement profile values comprise a rotated horizontal distance ($GK_x$) and a rotated vertical distance ($GK_y$).

The pair of second calibration node measurements may comprise a height $\hat{H}$ and a distance $\hat{D}$ between the second calibration node and the LDM based on the LDM distance signal $D_{LDM}$ and angle of inclination $\theta_{INC}$. For example, as set forth above in Equations 1-2, though now with respect to the second calibration node:

$$\hat{D}=D_{LDM}\cos(\theta_{INC}), \text{ and}$$

$$\hat{H}=D_{LDM}\sin(\theta_{INC}).$$

The second set of dimensions may be determined based on a following set of second dimension equations:

$$AK_y=\hat{H}+H_0; \text{ and}$$

$$AK_x=\hat{D}+D_0. \qquad \text{(Equations 23-24)}$$

Further, the implement profile values (IPV) comprise $GK_{y0}$ and $GK_{x0}$, which are determined by a following set of equations:

$$GK_{y0}=AK_y-AG_y; \text{ and}$$

$$GK_{x0}=AK_x-AG_x \qquad \text{(Equations 25-26)}$$

Figure 3:
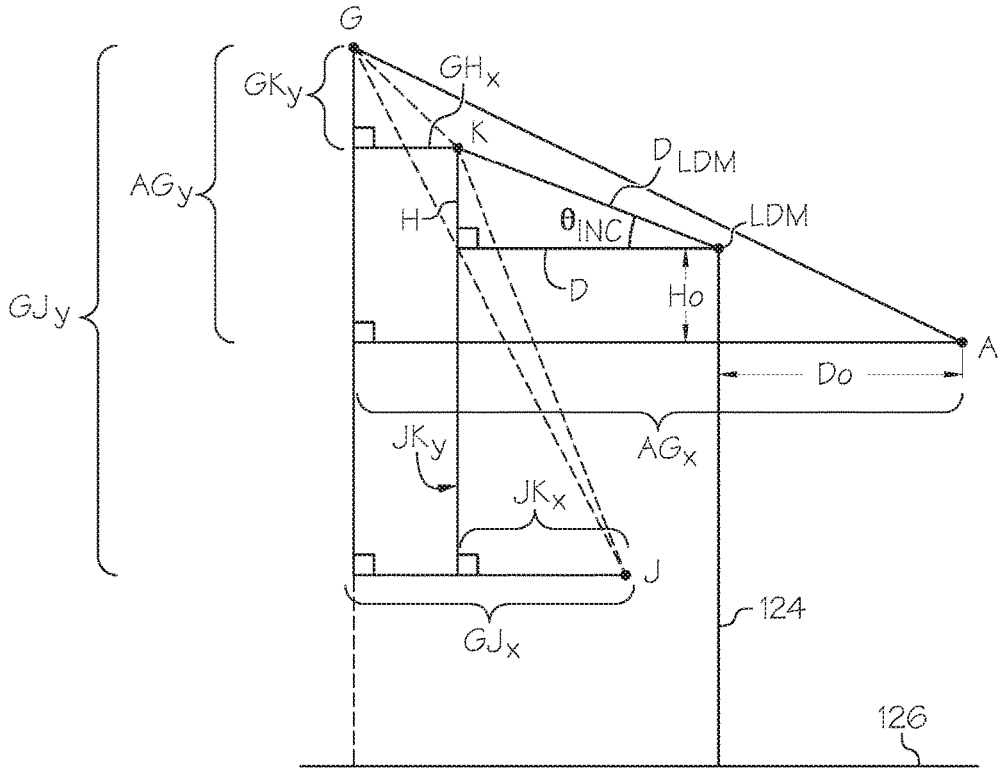
FIG. 3 is a side elevation view of a linkage assembly of an excavator calibration framework including a laser distance meter (LDM) and implement dimension points of an excavating implement of the excavator of FIG. 1.

With respect to Equations 25-26 and referring to FIG. 3, and as described above, $AG_x$ is a horizontal distance between the boom terminal point A and the terminal point G of the excavator stick 110, and $AG_y$ is a vertical distance between the boom terminal point A and the terminal point G of the excavator stick 110.

In embodiments, the second rotation factor may be at least partially based on $\theta_{tilt}$. Additionally, the set of rotated implement profile values comprise $GK_y$ and $GK_x$, which are based on a following set of implement profile rotation equations:

$$GK_y=GK_{x0}\cos(\theta_{tilt})-GK_{y0}\sin(\theta_{tilt}); \text{ and}$$

$$GK_x=GK_{y0}\sin(\theta_{tilt})+GK_{X0}\cos(\theta_{tilt}). \qquad \text{(Equations 27-28)}$$

The architecture controller may be programmed to, as illustrated in step 222 of FIG. 4, determine implement dimensions between the first calibration node and the second calibration node at least partially based on the set of rotated implement distance values (IDV) and the set of rotated implement profile values (IPV). For example, and referring to FIG. 3, the architecture controller is programmed to determine implement dimensions comprising a horizontal distance ($JK_x$) and a vertical distance ($JK_y$) between the terminal point J and the tilt point K at least partially based on the implement profile values ($GK_x$, $GK_y$) and the implement distance values ($GJ_x$, $GJ_y$). Further, the architecture controller may be programmed to operate the excavator using the implement dimensions, which may be, for example, the horizontal distance ($JK_x$) and the vertical distance ($JK_y$). Such implement dimensions may be based on a following set of equations:

$$JK_x=GJ_x-GK_x; \text{ and}$$

$$JK_y=GJ_y-GK_y. \qquad \text{(Equations 29-30)}$$

In embodiments, the architecture controller is further programmed to calibrate a z-axis of the implement dynamic sensor 120 to align with the tilt axis TA. For example, the z-axis of the implement dynamic sensor 120 is solved, for example, through a steady state acceleration utilizing a single axis alignment function that is at least partially based on at least three measurements. The tilt axis TA is positioned in a plane that intersects the gravity vector. A first, full left tilt measurement is taken after the excavating implement 114 has been rotated about the tilt axis to the left such that a leading edge of the excavating implement 114 is tilted to the left of the tilt axis in a direction facing the leading edge. A second, roughly zero tilt measurement is taken in which the excavating implement 114 is at roughly a zero tilt such that a leading edge of the excavating implement 114 is not tilted with respect to the tilt axis TA in the direction facing the leading edge. Further, a third, full right tilt measurement is taken after the excavating implement 114 has been rotated about the tilt axis to the right such that a leading edge of the excavating implement 114 is tilted to the right of the tilt axis in the direction facing the leading edge. An acceleration based z-axis alignment method assuming an acceleration along the tilt point K remains constant (and is the z-axis) while the other accelerations along the other two axes change during rotation. Thus, the z-axis alignment finds a rotation for the appropriate acceleration value that keeps a constant acceleration, which indicates that the associated axis is the z-axis pointing along the tilt axis TA that intersects the tilt point K. Thus, the z-axis of the implement dynamic sensor 120 may be determined and aligned with the tilt axis TA of the excavating implement 114.

Further, the architecture controller may be programmed to calibrate $\theta_{tilt}$ with respect to the tilt axis TA and at least partially based on an alignment of the LDM 124 with a center of the tilt point K, which intersects a point of the tilt axis TA, and a center point of a leading edge of the excavating implement 114. Either or both of the center of the tilt point K and the center point of a leading edge of the excavating implement 114 may be marked such as, for example, by a chalk marking.

The architecture controller may be further programmed to determine a set of measurements to assist with an LDM setup and the calibration prior to execution of the iterative process. The determination may be at least partially based on a measurement of a half-width of the excavating implement 114 to determine the center point of the leading edge of the excavating implement 114, and a measurement of the center of the tilt point K of the excavating implement 114. With respect to the LDM setup, the architecture controller may be further programmed to measure a center line of the excavator boom 108, align a measured center line of the excavator boom 108 with the LDM 124, align the LDM 124 with the center of the tilt point K, and pull the excavating implement 114 in toward the LDM 124 while keeping the LDM 124 aligned with the center of the tilt point K. Further, the architecture controller may be programmed to rotate at least one of the excavating linkage assembly 104 and the LDM 124 to keep the LDM 124 aligned with the center of the tilt point K.

It is contemplated that the embodiments of the present disclosure may assist to permit a speedy and more cost efficient method of determining excavating implement dimension lengths and angle offsets in a manner that minimizes a risk of human error and increased accuracy with such value determinations.

A signal may be "generated" by direct or indirect calculation or measurement, with or without the aid of a sensor.

For the purposes of describing and defining the present invention, it is noted that reference herein to a variable being a "function" of a parameter or another variable is not intended to denote that the variable is exclusively a function of the listed parameter or variable. Rather, reference herein to a variable that is a "function" of a listed parameter is intended to be open ended such that the variable may be a function of a single parameter or a plurality of parameters.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An excavator calibration framework comprising an excavator, a laser distance meter (LDM), a first laser reflector, and a second laser reflector, wherein:

the excavator comprises a machine chassis, an excavating linkage assembly, an implement dynamic sensor, an excavating implement, and control architecture;

the excavating linkage assembly comprises an excavator boom and an excavator stick that collectively define a plurality of linkage assembly positions;

the excavating implement is mechanically coupled to the excavator stick;

the excavating implement is configured to tilt about a tilt axis;

the implement dynamic sensor is positioned on the excavating implement and is configured to generate a tilt angle signal ($\theta_{tilt}$) representing an angular degree to which the tilt axis of the excavating implement is tilted with respect to horizontal;

the first laser reflector is positioned at a first calibration node on the excavating implement;

the second laser reflector is positioned at a second calibration node on the excavating implement;

the LDM is configured to generate a first LDM distance signal $D_{LDM1}$ indicative of a distance between the LDM and the first laser reflector and a first LDM angle of inclination signal $\theta_{INC1}$ indicative of an angle between the LDM and the first laser reflector;

the LDM is configured to generate a second LDM distance signal $D_{LDM2}$ indicative of a distance between the LDM and the second laser reflector and a second LDM angle of inclination signal $\theta_{INC2}$ indicative of an angle between the LDM and the second laser reflector; and the control architecture comprises one or more linkage assembly actuators and an architecture controller programmed to determine the tilt axis of the excavating implement relative to horizontal based on the tilt angle signal ($\theta_{tilt}$);

execute an iterative process to curl the excavating implement and create a set of bucket angles;

move the linkage assembly to align the LDM and the first calibration node;

calculate a pair of first calibration node measurements based on the first LDM distance signal $D_{LDM1}$ and the first LDM angle of inclination signal $\theta_{INC1}$;

determine a first set of dimensions comprising implement distance values and LDM offset values, wherein the first set of dimensions are at least partially based on the set of bucket angles and the pair of first calibration node measurements;

align the tilt axis with horizontal to generate a first rotation factor;

determine a set of rotated implement distance values at least partially based on the implement distance values and the first rotation factor;

move the linkage assembly to align the LDM and the second calibration node;

calculate a pair of second calibration node measurements based on the second LDM distance signal $D_{LDM2}$ and the second LDM angle of inclination signal $\theta_{INC2}$;

determine a second set of dimensions comprising implement profile values, wherein the second set of dimensions is at least partially based on the pair of second calibration node measurements and the LDM offset values;

align the tilt axis with horizontal to generate a second rotation factor;

determine a set of rotated implement profile values at least partially based on the implement profile values and the second rotation factor;

determine implement dimensions between the first calibration node and the second calibration node at least partially based on the set of rotated implement distance values and the set of rotated implement profile values; and operate the excavator using the implement dimensions.

2. An excavator calibration framework as claimed in claim 1, wherein:

the excavating implement comprises a terminal point J and a tilt point K;

the tilt point K intersects a point of the tilt axis and is disposed above the implement dynamic sensor;

the first calibration node is positioned at the terminal point J of the excavating implement; and the second calibration node is positioned at the tilt point K of the excavating implement.

3. An excavator calibration framework as claimed in claim 2, wherein:

the excavating implement is mechanically coupled to a terminal point G of the excavator stick that intersects a curl axis about which the excavating implement is configured to curl;

the implement distance values comprise a horizontal distance ($GJ_{x0}$) and a vertical distance ($GJ_{y0}$) between the terminal point G of the excavator stick and the terminal point J of the excavating implement;

the rotated implement distance values comprise a rotated horizontal distance ($GJ_x$) and a rotated vertical distance ($GJ_y$);

the implement profile values comprise a horizontal distance ($GK_{x0}$) and a vertical distance ($GK_{y0}$) between the terminal point G of the excavator stick and the tilt point K of the excavating implement; and the rotated implement profile values comprise a rotated horizontal distance ($GK_x$) and a rotated vertical distance ($GK_y$).

4. An excavator calibration framework as claimed in claim 1, wherein the pair of first calibration node measurements comprise a height H and a distance D between the first calibration node and the LDM based on the LDM distance signal $D_{LDM}$ and angle of inclination signal $\theta_{INC}$, such that $$D=D_{LDM}\cos(\theta_{INC}),\text{ and}$$

$$H=D_{LDM}\sin(\theta_{INC});\text{ and}$$

the LDM offset values define an offset horizontal distance ($D_0$) and an offset vertical distance ($H_0$) between a boom terminal point A and a laser origin of the LDM.

5. An excavator calibration framework as claimed in claim 4, wherein:

the first set of dimensions further comprise:

an offset bucket angle ($\theta_{bucket,offset}$); and a length (GJ) between the terminal point G and a terminal point J of the excavating implement, the first calibration node positioned at the terminal point J; and the first set of dimensions are determined based on a following set of first dimension equations:

$$AG_y+GJ\cos(\theta_{bucket}^{Measured}-\theta_{bucket,offset})=H+H_0;$$

and $$AG_x+GJ\sin(\theta_{bucket}^{Measured}-\theta_{bucket,offset})=D+D_0;$$

where $\theta_{bucket}$ is an actual bucket angle, $AG_x$ is a horizontal distance between the boom terminal point A and the terminal point G of the excavator stick, and $AG_y$ is a vertical distance between the boom terminal point A and the terminal point G of the excavator stick.

6. An excavator calibration framework as claimed in claim 5, wherein solutions to the first dimension equations are determined by a following solution set, in which:

$$cb=\cos(\theta_{bucket}^{Measured});$$

$$sb=\sin(\theta_{bucket}^{Measured}$$

$$rhs=[AG_x-D,AG_y-H];$$

$$lhs=[[\text{ones;zeros}],[\text{zeros;ones}],[cb;sb],[-sb;cb]];\text{ and}$$

$$sol=((lhs)(lhs)^T)^{-1}(lhs)^T(rhs);$$

from which a following set of solutions are determined:

$$H_0=sol(1);$$

$$D_0=sol(2);$$

$$cGJ=sol(3);$$

$$sGJ=sol(4);$$

$$\theta_{bucket,offset}=\tan^{-1}(SGJ,cGJ);$$

such that:

$$GJ_{sol,1}=sol(3)/\cos(\theta_{bucket,offset});$$

$$GJ_{sol,2}=sol(4)/\sin(\theta_{bucket,offset}).$$

7. An excavator calibration framework as claimed in claim 6, wherein:

$$GJ_{sol,1}=GJ_{sol,2};\text{ and}$$

$$GJ_{approx}=GJ_{sol,1};$$

such that the implement distance values comprise $GJ_{y0}$ and $GJ_{x0}$, which are determined as follows:

$$GJ_{y0}=cb*cGJ-sb*sGJ;\text{ and}$$

$$GJ_{x0}=sb*cGJ+cb*sGJ.$$

8. An excavator calibration framework as claimed in claim 7, wherein:

the first rotation factor is at least partially based on $\theta_{tilt}$; and the set of rotated implement distance values comprise $GJ_y$ and $GJ_x$, which are based on a following set of implement distance rotation equations:

$$GJ_y=GJ_{y0}\cos(\theta_{tilt})-GJ_{x0}\sin(\theta_{tilt});\text{ and}$$

$$GJ_x=GJ_{y0}\sin(\theta_{tilt})+GJ_{x0}\cos(\theta_{tilt}).$$

9. An excavator calibration framework as claimed in claim 1, wherein the pair of second calibration node measurements comprise a height $\hat{H}$ and a distance $\hat{D}$ between the second calibration node and the LDM based on the LDM distance signal $D_{LDM}$ and angle of inclination $\theta_{INC}$, such that $$\hat{D}=D_{LDM}\cos(\theta_{INC}),\text{ and}$$

$$\hat{H}=D_{LDM}\sin(\theta_{INC});\text{ and}$$

the LDM offset values define an offset horizontal distance ($D_0$) and an offset vertical distance ($H_0$) between a boom terminal point A and a laser origin of the LDM.

10. An excavator calibration framework as claimed in claim 9, wherein the second set of dimensions are determined based on a following set of second dimension equations:

$$AK_y=\hat{H}+H_0;$$

$$AK_x=\hat{D}+D_0;$$

such that the implement profile values comprise $GK_{y0}$ and $GK_{x0}$, which are determined by a following set of equations:

$$GK_{y0}=AK_y-AG_y; \text{ and}$$

$$GK_{x0}=AK_x-AG_x.$$

11. An excavator calibration framework as claimed in claim 10, wherein:

the second rotation factor is at least partially based on $\theta_{tilt}$; and the set of rotated implement profile values comprise $GK_y$ and $GK_x$, which are based on a following set of implement profile rotation equations:

$$GK_y=GK_{x0}\cos(\theta_{tilt})-GK_{y0}\sin(\theta_{tilt}); \text{ and}$$

$$GK_x=GK_{y0}\sin(\theta_{tilt})+GK_{x0}\cos(\theta_{tilt}).$$

12. An excavator calibration framework as claimed in claim 1, wherein the architecture controller is programmed to:

determine implement dimensions comprising a horizontal distance ($JK_x$) and a vertical distance ($JK_y$) between the terminal point J and the tilt point K at least partially based on the implement profile values ($GK_x$, $GK_y$) and the implement distance values ($GJ_x$, $GJ_y$); and operate the excavator using the horizontal distance ($JK_x$) and the vertical distance ($JK_y$).

13. An excavator calibration framework as claimed in claim 12, wherein the horizontal distance ($JK_x$) and the vertical distance ($JK_y$) are based on a following set of equations:

$$JK_x=GJ_x-GK_x; \text{ and}$$

$$JK_y=GJ_y-GK_y.$$

14. An excavator calibration framework as claimed in claim 1, wherein:

the excavating implement is mechanically coupled to a terminal point G of the excavator stick; and the terminal point G intersects a curl axis about which the excavating implement is configured to curl.

15. An excavator calibration framework as claimed in claim 14, wherein the iterative process comprises:

curling the excavating implement about the curl axis to a linkage assembly position, and determining a bucket angle ($\theta_{bucket}$) of the terminal point J relative to horizontal at the linkage assembly position, and the iterative process is repeated n times until n exceeds a threshold.

16. An excavator calibration framework as claimed in claim 1, wherein the architecture controller is further programmed to:

calibrate a z-axis of the implement dynamic sensor to align with the tilt axis.

17. An excavator calibration framework as claimed in claim 1, wherein the architecture controller is further programmed to:

calibrate $\theta_{tilt}$ with respect to the tilt axis and at least partially based on an alignment of the LDM with a center of a tilt point K, which intersects a point of the tilt axis, and a center point of a leading edge of the excavating implement.

18. An excavator calibration framework as claimed in claim 17, wherein the architecture controller is further programmed to determine a set of measurements to assist with an LDM setup and the calibration of $\theta_{tilt}$ prior to execution of the iterative process, the determination at least partially based on:

a measurement of a half-width of the excavating implement to determine the center point of the leading edge of the excavating implement; and a measurement of the center of the tilt point K of the excavating implement.

19. An excavator calibration framework as claimed in claim 18, wherein, with respect to the LDM setup, the architecture controller is further programmed to:

measure a center line of the excavator boom;

align a measured center line of the excavator boom with the LDM;

align the LDM with the center of the tilt point K; and pull the excavating implement in toward the LDM while keeping the LDM aligned with the center of the tilt point K.

20. An excavator calibration framework as claimed in claim 19, wherein the architecture controller is further programmed to rotate at least one of the excavating linkage assembly and the LDM to keep the LDM aligned with the center of the tilt point K.

* * * * *